United States Patent [19]

Nogradi

[11] Patent Number: 4,961,298

[45] Date of Patent: Oct. 9, 1990

[54] PREFABRICATED FLEXIBLE EXTERIOR PANEL SYSTEM

[76] Inventor: Jan Nogradi, Quality Lane, Box 219, Rutland, Vt. 05701

[21] Appl. No.: 401,015

[22] Filed: Aug. 31, 1989

[51] Int. Cl.[5] ..... E04B 2/28

[52] U.S. Cl. ..... 52/235; 52/309.7

[58] Field of Search ..... 52/235, 309.7, 309.8, 52/600, 509

[56] References Cited

U.S. PATENT DOCUMENTS

| | | | |
|---|---|---|---|
| 496,544 | 5/1893 | Strusholm . . | |
| 1,297,523 | 3/1919 | With . | |
| 1,379,882 | 5/1921 | Swartz . | |
| 1,807,630 | 6/1931 | McFarlin . | |
| 1,991,558 | 2/1935 | Keuls . | |
| 2,008,192 | 7/1935 | Stubbs . | |
| 2,049,907 | 8/1936 | Hess . | |
| 2,898,258 | 8/1959 | Meier et al. . | |
| 3,093,935 | 6/1963 | Dunn . | |
| 3,159,882 | 12/1964 | Slayter . | |
| 3,252,259 | 5/1966 | Gerhardt . | |
| 3,353,315 | 11/1967 | Barker . | |
| 3,381,437 | 5/1958 | Kidney . | |
| 3,389,518 | 6/1968 | Horback . | |
| 3,401,494 | 9/1968 | Anderson . | |
| 3,530,633 | 9/1970 | Scott | 52/235 X |
| 3,553,918 | 1/1971 | Dauson | 52/235 X |
| 3,884,009 | 5/1975 | Frohlich et al. . | |
| 3,936,986 | 2/1976 | Steel | 52/235 |
| 3,952,470 | 4/1976 | Byrd, Jr. . | |
| 4,044,520 | 8/1977 | Barrows . | |
| 4,075,805 | 2/1978 | Bongiovanni . | |
| 4,157,640 | 6/1979 | Joannes . | |
| 4,170,859 | 10/1979 | Counihan . | |
| 4,224,773 | 9/1980 | Schwörer . | |
| 4,333,290 | 6/1982 | Koberstein . | |
| 4,374,687 | 2/1983 | Yamamoto . | |
| 4,438,611 | 3/1984 | Bryant . | |
| 4,567,699 | 2/1986 | McClellan | 52/600 X |
| 4,633,634 | 1/1987 | Nemmer et al. . | |
| 4,641,469 | 2/1987 | Wood . | |
| 4,702,058 | 10/1987 | Bennett . | |
| 4,738,065 | 4/1988 | Crandell | 52/235 |
| 4,873,805 | 10/1989 | Ting | 52/235 |
| 4,873,806 | 10/1989 | Jeschke | 52/235 |

FOREIGN PATENT DOCUMENTS

| | | | |
|---|---|---|---|
| 2503429 | 7/1976 | Fed. Rep. of Germany . | |
| 1182861 | 6/1959 | France . | |
| 7308975 | 1/1974 | Netherlands . | |
| 2024908 | 1/1980 | United Kingdom | 52/235 |
| 2053312 | 2/1981 | United Kingdom . | |

OTHER PUBLICATIONS

*Thermalbar, The Energy Saver* by Keystone Systems, Inc.

*Primary Examiner*—Carl D. Friedman
*Assistant Examiner*—Lan Mai
*Attorney, Agent, or Firm*—Fleit, Jacobson, Cohn, Price, Holman & Stern

[57] ABSTRACT

A reinforced panel and a curtain wall construction using a plurality of the reinforced panels 10 each panel has a plastic foam board reinforced along one surface 30 by a plurality of parallel, spaced-apart reinforcing members 12. Conforming groves 14 cut into the interior surface 30 are filled with an adhesive 18 and the reinforcing members are inserted to the recesses 14, until the exposed surface of the reinforcing members is flush with surface 30. Terminal ends of the reinforcing members extend slightly beyond the edges of the panels 10, thereby enabling the reinforced panels to be attached to a building's substrate wall when erected to form a curtain wall.

18 Claims, 2 Drawing Sheets

PREFABRICATED FLEXIBLE EXTERIOR PANEL SYSTEM

BACKGROUND OF THE INVENTION

This invention relates to structural wall construction and, more particularly, to prefabricated, reinforced curtain wall panels.

BACKGROUND ART

Curtain wall construction practice for erection of exterior walls during construction or renovation frequently requires attachment of an insulating material such as polystyrene in the form of panels, to the exterior walls of the building, thereby sheathing the exterior of the building. This is done both during new construction and during renovation of buildings for purposes of both aesthetics and thermal efficiency.

In some of the earlier exterior insulation systems, panels were attached with fasteners extending from the exterior face of the panels, directly through the thickness of the panels and into the substrate provided by the building's wall. Later systems endeavored to either integrate insulating panels with separately erected structural shapes or to reinforce one or more panels with structural shapes inserted directly into the thickness of the panels.

Insulating panels themselves however, provide only a modicum of weather protection to the exterior of the building. Consequently, the panels are frequently coated, at least on their exterior surfaces. Joints between neighboring panels are typically filled, as for example with caulking applied after erection of the panels.

By nature, insulating panels are lightweight and flexible. Wind loading on the exposed panels therefore, creates significant suction forces, that is pressure extending from the inside of the building to the outside, which tend to deform the panels and frequently cause the panels to separate from the reinforcing members and any fasteners applied to directly engage the insulating panels. It has become desireable therefore, to enhance the bond between the reinforcing members in the panels, as well as between the panels and the underlining substrate surface provided by the vertical building wall. Among the efforts to enhance the bond between the reinforcing members and the panels has been the use of legs protruding from flanges embedded within, or alternatively slid into recesses formed on one side of the panel. The sliding nature of such engagement however, prevents a tight, permanent bond between the reinforcing member and the slot.

SUMMARY OF THE INVENTION

Accordingly, it is one object of the current invention to provide an improved exterior curtain wall panel.

It is another object to provide an easily erected, reinforced monolithic exterior curtain wall panel.

It is still another object to provide a prefabricated, monolithic exterior, reinforced curtain wall panel covering a surface area greater than currently available panels.

It is yet another object to provide a monolithic curtain wall panel able to exhibit an enhanced degree of flexibility during transportation, erection and weather exposure as an exterior vertical building wall.

It is still yet another object to provide a lightweight, monolithic, reinforced curtain wall.

These and other objects are achieved with an exterior curtain wall constructed with a plurality of one-piece slabs of expanded polystyrene each reinforced with a plurality of C-shaped cross-section reinforcing members. Each of the lightweight insulating plastic foam slabs has a plurality of spaced-apart, substantially parallel slots each exhibiting a first width, a first depth and first length extending from and opening through pairs of opposite edge surfaces. Each of the elongate reinforcing members exhibits a second width less than the first width and a web joining a pair of oppositely disposed flanges having second depths slightly less than the first depths and second lengths exceeding the first lengths. The reinforcing members are conformingly disposed and retained within different ones of the slots by a first adhesive of a water-based, acrylic co-polymer binder which fills the slots. A plurality of perforations along the webs enables the first adhesive to escape from a cavity formed between the slots, the oppositely disposed flanges and the web, thereby preventing the reinforcing members from "swimming" within the slots.

BRIEF DESCRIPTION OF THE DRAWINGS

A more complete appreciation of this invention, and many of the attendant advantages thereof, will be more readily apparent as the same becomes better understood by reference to the following detailed description when considered in conjunction with the accompanying drawings in which like reference symbols indicate the same or similar components and wherein.

DETAILED DESCRIPTION OF THE INVENTION

Figure 1:
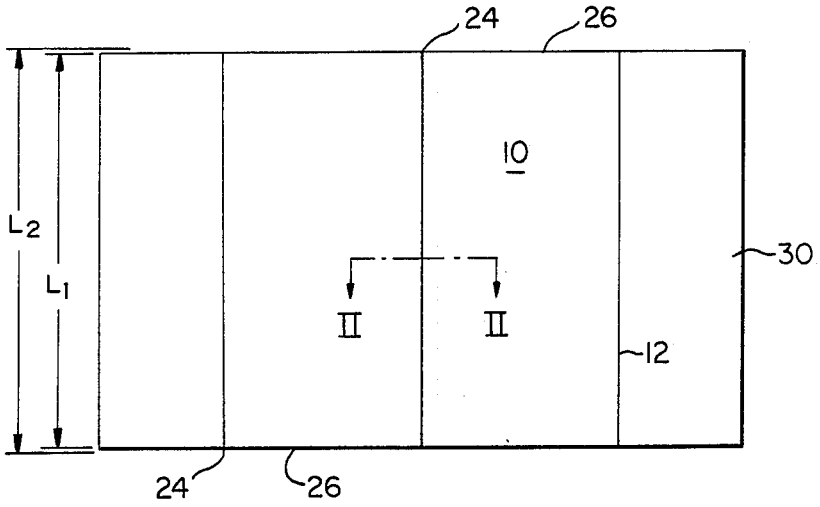
FIG. 1 is a plan view of a reinforced building panel constructed according to the principles of this invention.
Figure 2:
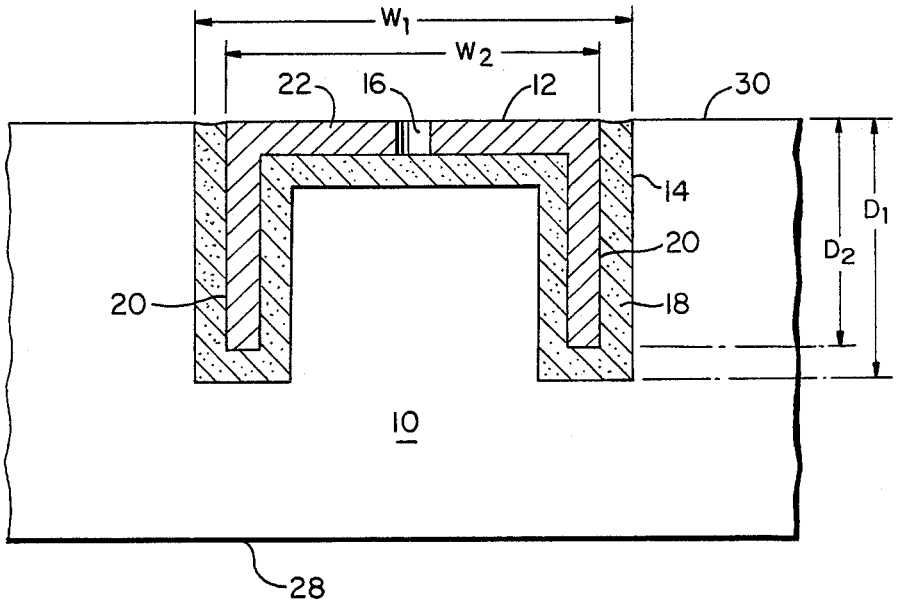
FIG. 2 is a cross-sectional view taken along line II-II' in FIG. 1.
Figure 3:
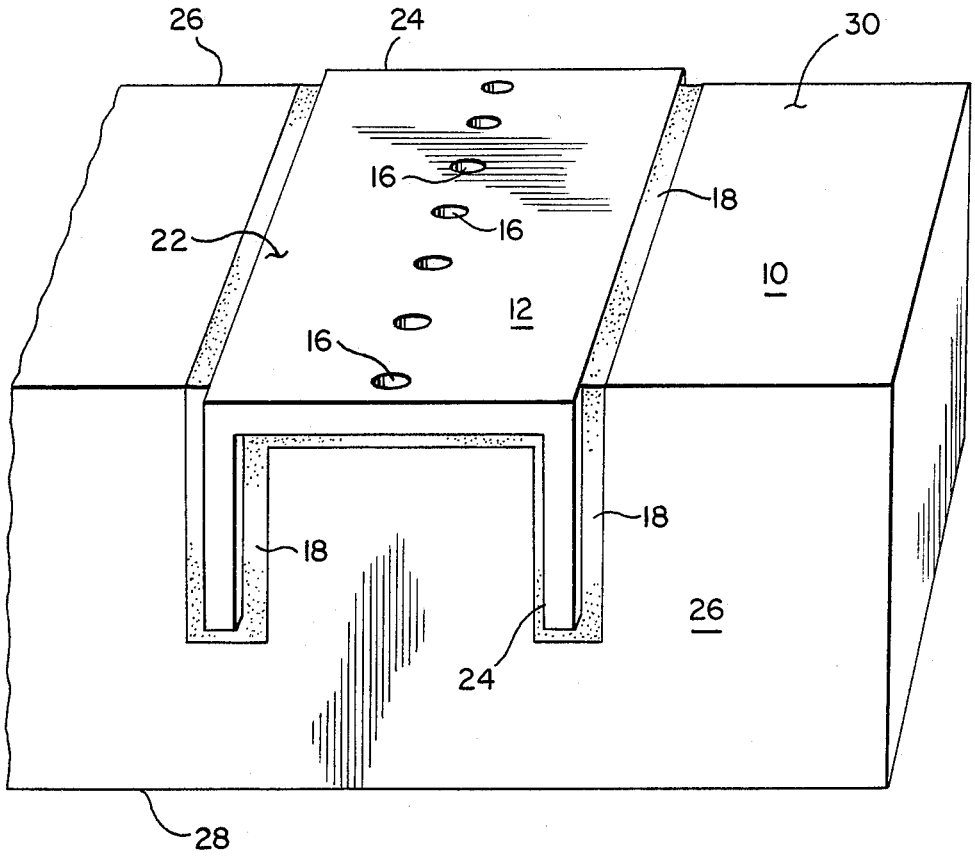
FIG. 3 is a perspective of a section of the embodiment shown in FIG. 1.

Referring now to the drawings, and more particularly to FIGS. 1, 2 and 33, a panel 10 made of a lightweight, thermally insulating material such as a one-piece slab of aged, plastic foam, for example, of expanded polystyrene board or extruded polyurethane board, is shown. Three reinforcing members 12 such as discrete aluminum channels having one inch flanges 20 joined by a centrally disposed two inch web 22, are recessed, as is shown in greater detail in the cross-sectional view provided by FIG. 2, into spaced-apart parallel channel shaped recesses 14 in one side 30 of panel 10. Preferably, recesses 14 are spaced on thirty-two inch centers. The webs 22 of reinforcing members 12 are perforated by a plurality of ventilating holes 16.

An active resin based adhesive coating 18 such as a commercially available two part polyurethane epoxy mixture, for example, or STO FLEXYL a polymer based adhesive, a proprietary compound currently available from STO Industries, Inc., Rutland, Vermont, is disposed between the side walls of recesses 14 and both surfaces of flanges 20 and the inner surface of web 20 of each channel. When the reinforcing members 12 are inserted into recesses 14 with the polymer based adhesive coating 18, ventilating holes 16, if in sufficient number, (e.g., one-quarter inch diameter holes based on six inch centers along the length of the web 22), will enable the adhesive coating 18 to escape from between the recesses and web 22, thereby preventing the reinforcing members from "swimming" within the recesses 14. Ideally, recesses 14 should be of greater depth than the width of flange 20 while the width of recesses 14 should exceed the width of webs 22, thereby assuring that all surfaces of reinforcing member 12 are separated from the adjacent, neighboring surfaces of recesses 14 by an intermediate portion of adhesive coating 18, thus strengthening the bond between reinforcing members 12 and panel 10.

The lengths of reinforcing members 12 exceed the corresponding transverse dimension of panel 10, as indicated in FIG. 1, whereby both ends of each reinforcing member provides protruding terminals 24 extending beyond the edge surfaces 26 of panel 10. Consequently, protruding terminals 24 may be used to attach the completed, reinforced panels to the vertical sides of a building, as by fasteners extending directly through protruding terminals 24 and into a receiving surface on the wall of the building.

Ideally, the reinforced panels of this invention are shop fabricated, in advance of erection. A lightweight, insulating plastic foam board made from a slab of material such as extruded polyurethane or expanded polystyrene of width less than 25 flame spread (per ASTM E84), and average density of about one pound per cubic foot ($\mu$=0.26 per inch, ASTM C578-85 Class A) may be used. The dimensional tolerances are preferably followed with edges of the board square to within one-sixteenth inch over the entire length of the board and the thicknesses within ± one-sixteenth of an inch. Thicknesses of slabs 10 may be between 2½ inch and 4 inches. Slabs 10 should be aged by air drying for a minimum of six weeks, or kiln dried for an equivalent period. Proper bead fusion and structural strength should be exhibited by slabs 10.

Typical dimensions of the slabs range upwardly to five feet and width and twelve feet in length. Dimensions should be checked in the slab cut and trimmed after being measured. The resulting board should be flat, and surface 28 true and free of surface marks, blemishes and striations. The board is then turned over and parallel slits are cut across the width of surface 30 approximately one and one-quarter inch deep by three-eighth inches wide to accommodate flanges 20 with a central slot approximately two inches wide to accommodate web 22. The channel shaped recesses are spaced thirty-two inches on center and sixteen inches on center from the ends of the board 10. The C-shaped reinforcing members 12 are cut to the exact width of board 10 plus one inch for the two terminal ends 24 (that is, one-half inch terminal ends of each reinforcing member extends beyond both of the board's edges). The channel Shaped recesses extend between and are open through opposite edge surfaces 26. Ventilating holes one-quarter inch in diameter are spaced six inches on center along the center line of web 22. The reinforcing members are cleaned thoroughly with acetone for example, to remove all surface contamination, and allowed to dry. A liberal amount of liquid phase adhesive 18 is introduced into the groves forming the channel shaped recesses 14 and the reinforcing members 12 are firmly pressed into channels 14 until the outer surfaces of web members of webs 22 is flushed with surface 30. Excess adhesive material protruding through ventilating holes 16 is removed, and the reinforced board 10 is allowed to fit, and not disturb for approximately forty-eighth hours.

A ready-mixed, non-cementitious, 100% acrylic copolymer emulsion-based, water resistant, vapor permeable, chopped glass fiber reinforced ground coat may be applied in a thickness of about 1/16 of an inch, to the surface 28 of panel 10 opposite from the surface 30 into which reinforcing members 12 are recessed. The ground coat may be tinted to any particular color desired. A reinforced fiber mesh fabric with symmetrical, interlaced glass fiber made from twisted multi-end strands and coated to be alkaline resistant at at least twenty grams per square yard may be applied to surface 28. Such mass fabric shall be shift proof with trimmed roll edges to minimize build-up of overlapped seams. The reinforcing fiber mesh should be back wrapped at all corners onto the back side of the panel by a minimum of four inches, and overlap not less than two and one-half inches at mesh joints. Wrinkles in the mesh should be avoided. The entire thickness of the ground coat should be thoroughly dry before applying the finish coat. A finish coating of a ready-mixed acrylic based wall coating of appropriate texture, color and aggregate size is then applied to the exposed surface 28.

Completed panels may then be transported to a job site and protected from elements and abuse. Using a measuring device and chalk line mark, the areas on the substrate wall that are to receive the prefabricated panels may be marked, allowing one-half inch joints between panels and where panels abut. Joints should be provided between panels where expansion or control joints occur in the substrate. A copolymer based adhesive is applied to the entire back surface 30 into the outer surfaces of webs 22, and the panel is positioned against the building's substrate wall while pressed firmly to ensure that the adhesive makes contact with the face of substrate wall. Alignment is checked and adjusted, and the terminal ends of the reinforcing members fastened to the substrate wall with corrosion resistant fasteners. A backer rod (preferably exhibiting about 25% compression) may be inserted into seal and joints between adjacent erected panels to provide a depth with ratio of sealant, as recommended by the sealant's manufacturer. Then, an expansion joint sealant may be applied into the joint and tooled flush with the ground coat on surface 28.

It is apparent from the foregoing description that the exterior wall panel disclosed may be constructed according to the principles destructed with a one-piece slab 10 of plastic foam material having a pair of opposite edge surfaces (e.g., 26) disposed between the opposite major surfaces, with one of the major surfaces (e.g., 30) being divided by a plurality of substantially parallel, spaced-apart slots 14 having cross-sections exhibiting a width W1, a depth D1 and exhibiting lengths L1 extending between and opening through the pair of opposite edge surfaces 26. Slab 10 is reinforced by a plurality of elongate reinforcing members 12 having C-shaped cross-sections with a width W2 less than width W1 and a web 22 joining a pair of oppositely disposed flanges 20 having depths D2 greater than depth D1 and lengths L2 exceeding lengths L1, conformingly disposed within different ones of slots 14. Web 22 of each of the reinforcing members is flush with the one of said major surfaces (e.g., 30) and is perforated along length L2 by a plurality of apertures 16.

First adhesive means 18 is disposed within slots 14, for retaining the plurality of reinforcing members 12 within corresponding ones of slots 14 within slab 10. The first adhesive means 18 consists essentially of a water-based acrylic co-polymer binder. Various modifications and alterations of the prefabricated, reinforced panels and curtain walls disclosed may be made without departing from the principles of this invention.

I claim:

1. An exterior wall panel, comprising:

a one-piece slab of plastic foam material having a pair of opposite major surfaces and a pair of opposite edge surfaces disposed between said opposite major surfaces, one of said major surfaces being divided by a plurality of substantially parallel, spaced-apart slots having cross-sections exhibiting a first width, a first depth and exhibiting first lengths extending between and open through said pair of opposite edge surfaces;

a plurality of elongate reinforcing members having a C-shaped cross-section with a second width less than said first width and a web joining a pair of oppositely disposed flanges having second depths less than said first depth and second lengths exceeding said first lengths, conformingly disposed within different ones of said slots, said web of each of said reinforcing members being flush with said one of said major surfaces and being perforated along said second lengths by a plurality of apertures; and first adhesive means disposed within said slots for retaining said plurality of reinforcing members within corresponding ones of said slots within said one-piece slab, said first adhesive means consisting essentially of a water-based acrylic co-polymer binder.

2. The wall panel of claim 1, wherein said slot has a pair of oppositely disposed side walls and said first adhesive means is disposed within said slots and separates said side walls from said flanges.

3. The wall panel of claim 1, further comprising second adhesive means consisting essentially of a non-cementitious, acrylic co-polymer, emulsion-based, water-resistant, vapor permeable glass fiber reinforced composition disposed over the other of said opposite major surfaces, for shielding said slab from exposure to weather.

4. The wall panel of claim 3, further comprising an acrylic-based wall coating covering the said second adhesive means.

5. An exterior curtain wall, comprising:

a plurality of one-piece slabs of plastic foam material, each of said slabs having a pair of opposite major surfaces and a pair of opposite edge surfaces disposed between said opposite major surfaces, one of said major surfaces being divided by a plurality of substantially parallel, spaced-apart slots having C-shaped cross-sections exhibiting a first width and a first depth, and exhibiting first lengths extending between and open through said pair of opposite edge surfaces;

a plurality of elongate reinforcing members having a C-shape cross-section with a web exhibiting a second width less than said first width and centrally disposed between and joining a pair of oppositely disposed flanges having second depths less than said first depth and second lengths exceeding said first lengths with protruding end portions, conformingly disposed within different ones of said slots, said web of each of said reinforcing members being flush with said one of said major surfaces and perforated along said second lengths by a plurality of apertures;

first adhesive means disposed within said slots for retaining said plurality of reinforcing members with corresponding ones of said slots within said one-piece slab, said first adhesive means consisting essentially of a water-based, acrylic co-polymer binder;

second adhesive means consisting essentially of a water-based polymer disposed on said one major surface and said flange, for attaching said one-piece slabs with said plurality of reinforcing means, to an exterior wall of a building.

6. The curtain wall panel of claim 5, wherein said slot has a pair of oppositely disposed side walls and said first adhesive means is disposed within said slots and separates said side walls from said flanges.

7. The curtain wall of claim 6, further comprising third adhesive means consisting essentially of a non-cementitious, acrylic co-polymer, emulsion-based, water-resistant, vapor permeable glass fiber reinforced composition disposed over the other of said opposite major surfaces of each of said plurality of slabs, for shielding said slabs from exposure to weather.

8. The curtain wall of claim 5, further comprising third adhesive means consisting essentially of a non-cementitious, acrylic co-polymer, emulsion-based, water-resistant, vapor permeable glass fiber reinforced composition disposed over the other of said opposite major surfaces of each of said plurality of slabs, for shielding said slabs from exposure to weather.

9. The curtain wall of claim 8, further comprising an acrylic-based wall coating covering said third adhesive means.

10. An exterior curtain wall, comprising:

a plurality of one-piece slabs of plastic foam material, each of said slabs having a pair of opposite major surfaces and a pair of opposite edge surfaces disposed between said opposite major surfaces, one of said major surfaces being divided by a plurality of substantially parallel, spaced-apart slots having cross-sections exhibiting a first width and a first depth, and exhibiting first lengths extending between and opening through said pair of opposite edge surfaces;

a plurality of elongate reinforcing members having cross-sections with a web exhibiting a second width less than said first width and centrally disposed between and joining a pair of oppositely disposed flanges having second depths less than said first depth and second lengths exceeding said first lengths with protruding end portions, conformingly disposed within different ones of said slots, said web of each of said reinforcing members being flush with said one of said major surfaces and perforated along said second lengths by a plurality of apertures;

first adhesive means disposed within said slots for retaining said plurality of reinforcing members with corresponding ones of said slots within said one-piece slab, said first adhesive means consisting essentially of a water-based, acrylic co-polymer binder;

second adhesive means consisting essentially of a water-based polymer disposed on said one major surface and said flange, for attaching said one-piece slabs with said plurality of reinforcing means, to an exterior wall of a building.

11. The curtain wall panel of claim 10, wherein said slot has a pair of oppositely disposed side walls and said first adhesive means is disposed within said slots and separates said side walls from said flanges.

12. The curtain wall of claim 11, further comprising third adhesive means consisting essentially of a non-cementitious, acrylic co-polymer, emulsion-based, water-resistant, vapor permeable glass fiber reinforced composition disposed over the other of said opposite major surfaces of each of said plurality of slabs, for shielding said slabs from exposure to weather.

13. The curtain wall of claim 10, further comprising third adhesive means consisting essentially of a non-cementitious, acrylic co-polymer, emulsion-based, water-resistant, vapor preamble glass fiber reinforced composition disposed over the other of said opposite major surfaces of each of said plurality of slabs, for shielding said slabs from exposure to weather.

14. The curtain wall of claim 13, further comprising an acrylic-based wall coating covering said third adhesive means.

15. An exterior wall panel, comprising:

a slab of plastic foam material having a pair of opposite major surfaces and a pair of opposite edge surfaces disposed between said opposite major surfaces, one of said major surfaces being divided by a plurality of substantially parallel, spaced-apart slots having cross-sections exhibiting a first width, a first depth and exhibiting first lengths extending between and opening through said pair of opposite edge surfaces;

a plurality of elongate reinforcing members having a cross-section with a second width less than said first width and a web joining a pair of oppositely disposed flanges having second depths less than said first depth and second lengths exceeding said first lengths, conformingly disposed within different ones of said slots, said web of each of said reinforcing members being flush with said one of said major surfaces and being perforated along said second lengths by a plurality of apertures; and first adhesive means disposed within said slots for retaining said plurality of reinforcing member within corresponding ones of said slots within said one-piece slab, said first adhesive means consisting essentially of a water-based acrylic co-polymer binder.

16. The wall panel of claim 15, wherein said slot has a pair of oppositely disposed side walls and said first adhesive means is disposed within said slots and separates said side walls from said flanges.

17. The wall panel of claim 16, further comprising second adhesive means consisting essentially of a non-cementitious, acrylic co-polymer, emulsion-based, water-resistant, vapor permeable glass fiber reinforced composition disposed over the other of said opposite major surfaces, for shielding said slab from exposure to weather.

18. The wall panel of claim 17, further comprising an acrylic-based wall coating converting the said second adhesive means.

* * * * *